US007145583B2

(12) United States Patent
Ito

(10) Patent No.: US 7,145,583 B2
(45) Date of Patent: Dec. 5, 2006

(54) THERMAL PRINTER

(75) Inventor: Akihiko Ito, Chiba (JP)

(73) Assignee: Seiko Instruments Inc. (JP)

( * ) Notice: Subject to any disclaimer, the term of this patent is extended or adjusted under 35 U.S.C. 154(b) by 171 days.

(21) Appl. No.: 10/942,454

(22) Filed: Sep. 16, 2004

(65) Prior Publication Data

US 2005/0068405 A1 Mar. 31, 2005

(30) Foreign Application Priority Data

Sep. 18, 2003 (JP) ..... 2003-325752

(51) Int. Cl.
*B41J 25/304* (2006.01)
*B41J 25/34* (2006.01)

(52) U.S. Cl. ..... 347/197

(58) Field of Classification Search ..... 347/197, 347/220; 400/120.16
See application file for complete search history.

(56) References Cited

U.S. PATENT DOCUMENTS 5,051,009 A 9/1991 Sugiura et al. ..... 400/120
5,366,302 A 11/1994 Masumura et al. .... 400/120.16
5,694,159 A 12/1997 Kajiya et al. ..... 347/197
6,008,832 A * 12/1999 Sato ..... 347/197
6,765,602 B1 * 7/2004 Mori ..... 347/220
2004/0080604 A1 * 4/2004 Ito ..... 347/197

FOREIGN PATENT DOCUMENTS

EP 0857580 8/1998

* cited by examiner

*Primary Examiner*—Huan Tran
(74) *Attorney, Agent, or Firm*—Adams & Wilks

(57) ABSTRACT

Provided is a thermal printer which provides ease of maintenance, such as ease of replacement of the thermal head, and which can shorten the time required for maintenance work and reduce maintenance cost. The thermal printer is one which performs printing on a sheet sandwiched between a thermal head having a heat generating element and a platen roller, and includes a first frame (outer frame 18) for retaining a printing mechanism including the thermal head and the platen roller; a head support member to which the thermal head is secured; a pressure plate that detachably retains the head support member; a joining member for joining the head support member and the pressure plate together; a support shaft (shaft 20) passed through a shaft hole provided in each of both side walls of the first frame, the support shaft rotatably supporting the head support member; a second frame (lock arm 17) which is rotatable integrally with the pressure plate about the support shaft; and an urging member suspended between the pressure plate and the second frame, for generating a pressing force between the thermal head and the platen roller in a state where the head support member is joined to the pressure plate.

5 Claims, 6 Drawing Sheets

17
18c
17a
18L
20
18d
18R
18a
21
18B
18b
13
13a
15b
18F
16
17d

THERMAL PRINTER

BACKGROUND OF THE INVENTION

1. Field of the Invention

The present invention relates to a thermal printer that performs printing on a sheet sandwiched between a thermal head and a platen roller, and more specifically to an attachment and detachment mechanism for a thermal head.

2. Description of the Related Art

Thermal printers are often employed as, for example, printers for performing receipt printing at cash registers, portable label printers for printing POS labels on food products or for printing labels for distribution control, or the like. In a thermal printer, a thermal head having a heat generating element is brought into press contact with a platen roller, with printing performed on a heat-sensitive recording sheet sandwiched between the two members.

In conventional thermal printers, for example, a thermal head is fixed to a head support member also serving as a heat radiation plate, and the head support member is axially supported to an outer frame or the like of the printer so as to be freely rotatable, with the head support member being urged by a spring or the like to be pressed toward the platen roller side (for example, see JP 2000-318260 A).

In such conventional thermal printers, when, for instance, defects develop in the print dots produced by the thermal printer due to the influence of excessive energization, damage on the sheet, etc., the only way to solve this problem is to dissemble the entire printer assembly to replace the thermal head, and such an operation is extremely troublesome.

In particular, in the conventional thermal printers, an E-shaped fastening fitting, namely the so-called E-ring, is fastened and secured to a shaft for axially supporting the head support member to the outer frame of the printer so that the shaft is securely fixed and does not slide sideways, or, alternatively, a support shaft provided so as to project from the either right and left side surface of the head support member is press-fitted to a bearing provided on the outer frame to be fixed in place. The above construction of the conventional printers makes it hard to detach the head support member with ease. Further, it is also impossible to detach only the thermal head portion while the head support member is incorporated in the printer main body as it is.

Generally speaking, in the case of thermal printers for printing letters or the like, a printing failure of a single dot does not really necessitate replacement of the thermal head. In recent years, however, label printers that perform label printing for delivery control are often used for barcode printing, and if, as anticipated, barcodes are to be printed in increasingly thinner lines in the future, even slight chipping or loss of dot may cause trouble. Hence, it is conceivable that replacement of the thermal head due to dot failures, etc. will become more frequent than was previously the case.

In view of the above, the inventors of the present invention have proposed a thermal printer which includes a lock arm that movably holds a head support member, an urging means suspended between the head support member and the lock arm and adapted to generate a pressing force between a thermal head and a platen roller, and an outer frame that holds the lock arm and the platen roller, in which the thermal head, the head support member, and the urging means are capable of being attached to and detached from the outer frame while being assembled onto the lock arm (JP 2002-283230 B). With the thermal printer, the thermal head portion can be readily removed from the printer main body, facilitating replacement of the thermal head portion.

In the thermal printer proposed in the above previously filed patent application, however, the thermal head, the head support member, and the urging means are assembled onto the lock arm, which means that when replacing the thermal head, it is also necessary to replace the head support member, the urging means, and the like together with the thermal head, leading to an increase in parts cost. Conceivably, an improvement in this respect will enable a further reduction in maintenance cost.

It is an object of the present invention to provide a thermal printer which provides ease of maintenance, such as ease of replacement of the thermal head, and which can shorten the time required for maintenance work and reduce maintenance cost.

SUMMARY OF THE INVENTION

According to the present invention, to achieve the above object, there is provided a thermal printer which performs printing on a sheet sandwiched between a thermal head having a heat generating element and a platen roller, the thermal printer including: a first frame (outer frame 18) for retaining a printing mechanism including the thermal head and the platen roller; a head support member (15) to which the thermal head is secured; a pressure plate (16) that detachably retains the head support member; joining means for joining the head support member and the pressure plate together; a support shaft (shaft 20) passed through a shaft hole provided in each of both side walls of the first frame, the support shaft rotatably supporting the head support member; a second frame (lock arm 17) which is rotatable integrally with the pressure plate about the support shaft; and urging means suspended between the pressure plate and the second frame, for generating a pressing force between the thermal head and the platen roller in a state where the head support member is joined to the pressure plate.

Preferably, the head support member has in a lower part of its each side surface an engaging portion (15*b*) adapted to engage with the support shaft, the head support member being placed into a predetermined position by rotating the head support member toward the pressure plate by engaging the engaging portion with the support shaft.

More specifically, the head support member has a locking portion (15*a*) for joining the head support member to the pressure plate, and the pressure plate has a rest portion (16*a*) on which the locking portion is placed to rest. The head support member and the pressure plate are joined together by fastening with a screw (12) while the locking portion and the rest portion are held in contact with each other. Here, it is desirable that the locking portion be composed of a U-shaped locking piece capable of engaging with the screw.

According to the present invention, by arranging the urging means between the pressure plate and the second frame and joining the head support member, to which the thermal head is secured, to the front surface of the pressure plate, it is possible to obtain a pressing force for urging the thermal head toward the platen roller. Also, the head support member is constructed so as to be attachable to and detachable from the pressure plate, facilitating replacement of the thermal head. Further, unlike according to the previously filed application (JP 2002-283230 B), when replacing the thermal head, it is not necessary to replace the whole frame onto which the thermal head, the head support member, and the urging means are assembled, making it possible to avoid an increase in parts cost and to achieve a reduction in maintenance cost. Further, while a connector for connecting to an FPC is provided on the back surface portion of the thermal head, only the head support member can be detached according to the present invention, facilitating attachment and detachment of the FPC as well.

Further, the engaging portion that engages with the support shaft is provided in a lower part of either side surface of the head support member, and the head support member can be rotated into a predetermined position by engaging the engaging portion with the support shaft, whereby positioning on the head support member can be performed with relative ease. That is, the position in the back and forth direction of the head support member is fixed, whereby the head support member and the pressure plate can be readily brought into intimate contact with each other, which makes it possible to efficiently release the heat of the thermal head.

Further, the head support member and the pressure plate are joined together with the screws, enabling attachment and detachment of the head support member by means of a relatively simple structure.

Further, the locking portion is constituted by the U-shaped locking piece, whereby the locking piece of the head support member can be brought into engagement with each screw without fully unscrewing the screw from the rest portion provided in the pressure plate, thereby achieving a marked improvement in operability, and there is no fear of the screws getting lost.

DETAILED DESCRIPTION OF THE PREFERRED EMBODIMENTS

Hereinbelow, a preferred embodiment of the present invention is described in detail with reference to the drawings.

Figure 1C:
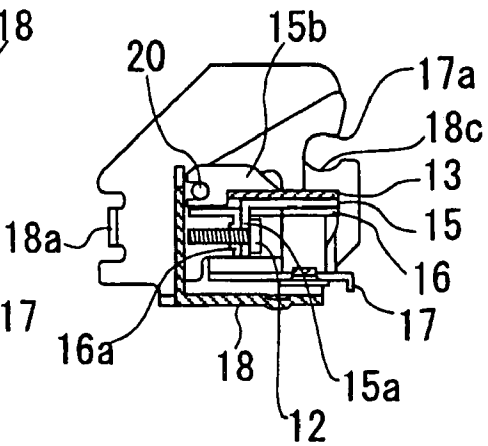
FIGS. 1A through 1C are respectively a top view, a bottom view, and a cross-sectional view taken along the line A—A of FIG. 1A, of a printing mechanism of a thermal printer according to a preferred embodiment of the present invention.
Figure 1A:
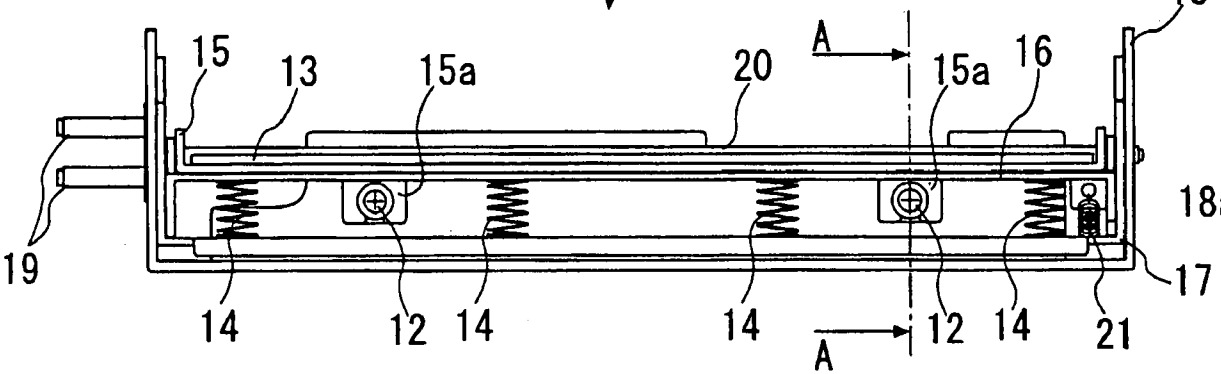
Figure 1B:
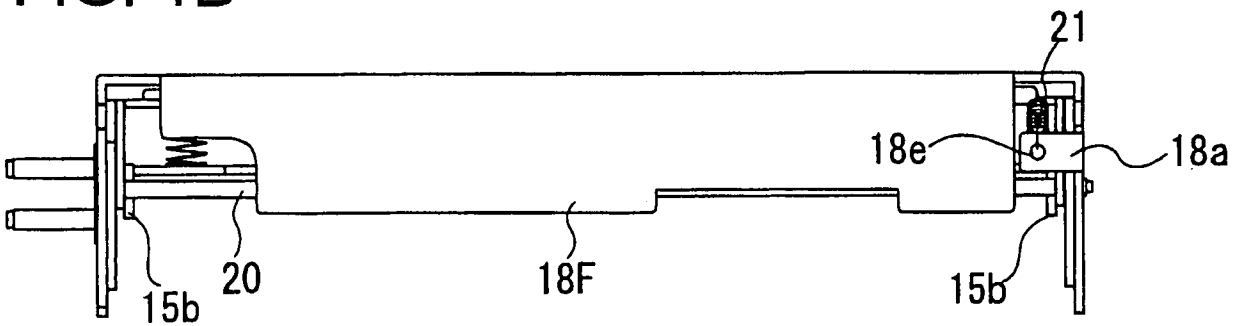
Figures 2A, 2B, 2C, 2D:
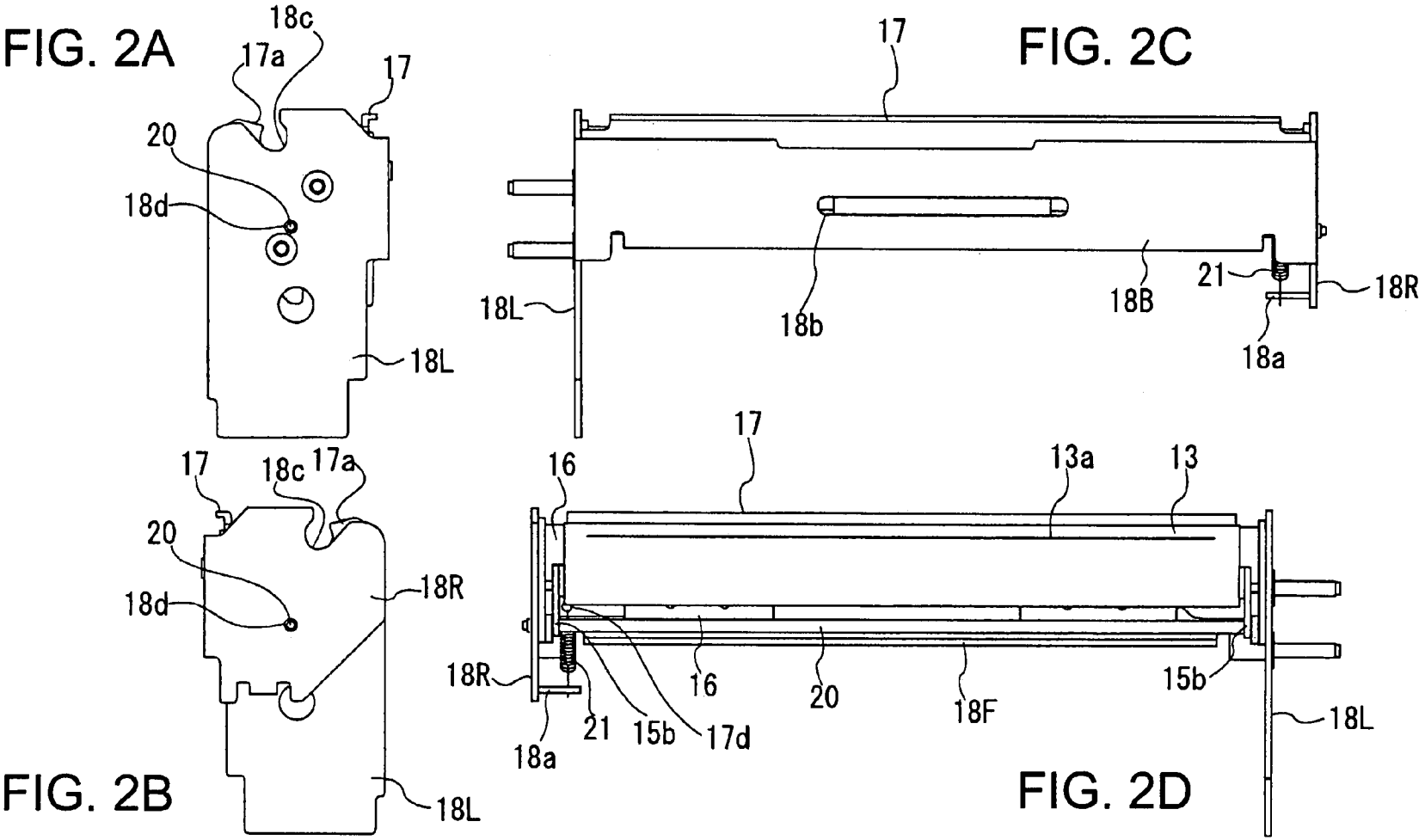
FIGS. 2A through 2D are respectively a left-hand side view, a right-hand side view, a rear view, and a front view of the printing mechanism of the thermal printer according to the embodiment of the present invention.
Figure 3:
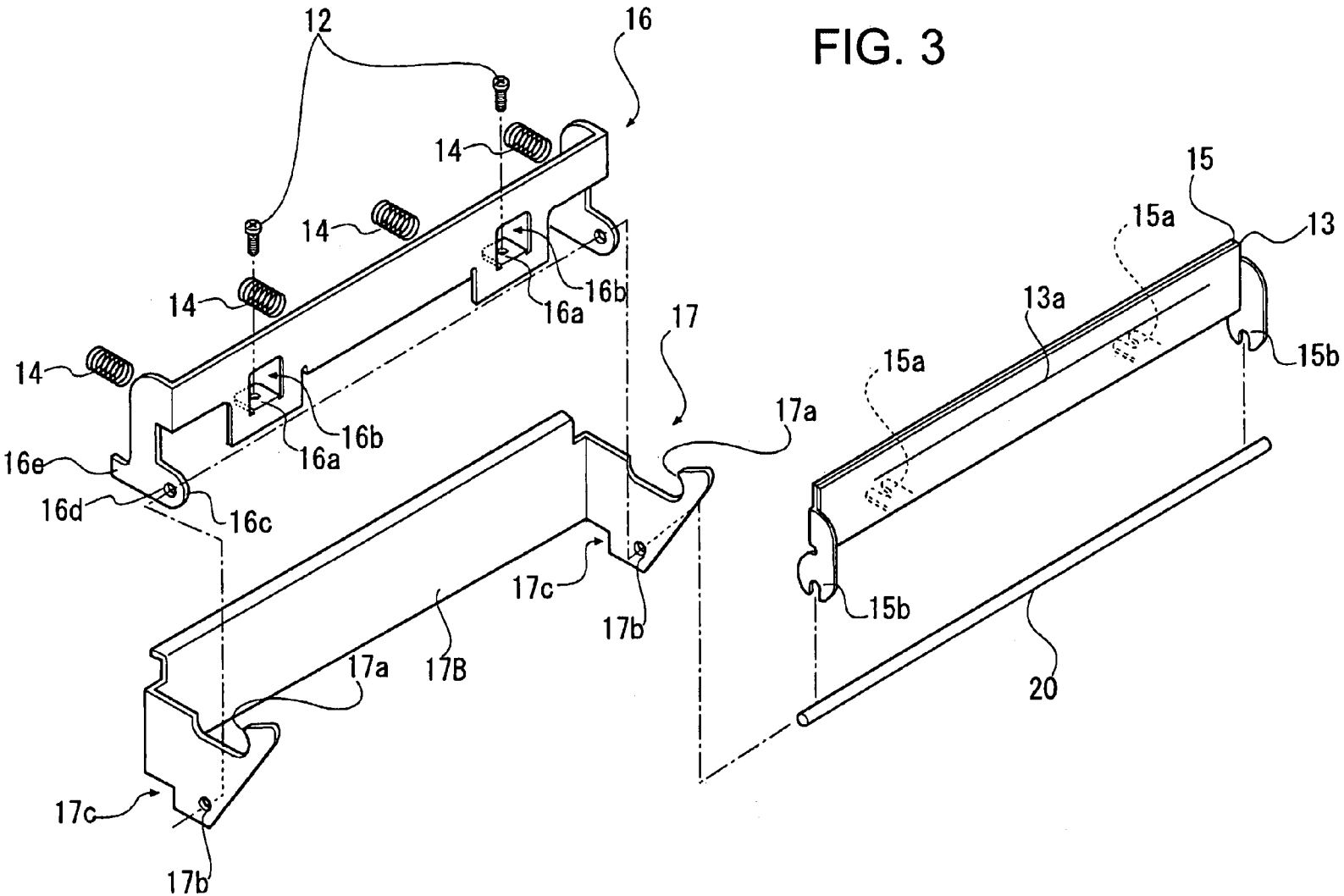
FIG. 3 is an exploded perspective view of portions (a lock arm 17, a pressure plate 16, and a head support member 15) that are integrally assembled onto the lock arm 17.

FIG. 1A is a top view showing a printing mechanism of a thermal printer to which the present invention is suitably applied, FIG. 1B is a bottom view thereof, and FIG. 1C is a cross-sectional view thereof taken along the line A—A of FIG. 1A. FIG. 2A is a left-hand side view showing the printing mechanism of the thermal printer of this embodiment, FIG. 2B is a right-hand side view thereof, FIG. 2C is a back view thereof, and FIG. 2D is a front view thereof. FIG. 3 is an exploded perspective view of portions (a lock arm 17, a pressure plate 16, and a head support member 15) that are assembled integrally onto the lock arm 17.

The thermal printer according to this embodiment is, although not particularly limited to, a portable label printer for performing printing on a sheet, specifically a recording sheet with attached release paper (hereinafter referred to as the label paper) whose adhesive surface on the back side is exposed by peeling off the release paper. The thermal printer has a horizontally elongate construction so that it can produce relatively broad prints.

As shown in FIGS. 1A through 3, the thermal printer of this embodiment is equipped with: a thermal head 13 having multiple heat generating elements 13*a* arranged horizontally in a row; a platen roller (not shown) adapted to press a sheet against the portion of the thermal head 13 where the heat generating elements 13*a* are arranged and feed the sheet as it rotates; an outer frame 18 surrounding a printing mechanism 10 including the thermal head 13 and the platen roller; a head support member 15 which supports the thermal head 13 and functions as radiating means for radiating heat of the thermal head 13; a pressure plate 16 that detachably holds the head support member; a shaft 20 passed through shaft holes provided on both side walls of the outer frame 18 and rotatably supporting the head support member 15 etc.; a lock arm 17 formed so as to be integrally rotatable with the pressure plate 16 about the shaft 20 and locking the platen roller with a bearing for rotatably supporting the platen roller held between the lock arm 17 and the outer frame 18; coil springs 14 arranged between the pressure plate 16 and a back surface portion 17B of the lock arm 17 and serving as urging means for urging the two members so as to repel each other; a stepping motor (not shown) for rotationally driving the platen roller through the intermediation of a gear etc.; and the like.

The head support member 15 has the thermal head 13 secured to its front surface portion and has locking pieces 15*a* provided in a lower part of its back surface and protruding toward the pressure plate 16 side at a substantially right angle. A U-shaped recess is formed in each locking piece 15*a*, allowing the recess to engage with each of screws 12 without having to unscrew the screws 12 from rest portions 16*a* of the pressure plate 16 which will be described later. Further, a back surface portion of the thermal head 13 secured to the front surface portion of the head support member 15 is exposed from a lower part in the back surface of the head support member 15, with a connector 13*b* for connecting FPC (Flexible Print Circuit) being arranged in substantially the center of the thus exposed back surface portion of the thermal head.

Further, provided in a lower part of right and left side walls of the head support member 15 are U-shaped locking portions 15*b* adapted to engage with the shaft 20. The locking portions 15*b* enable the head support member 15 to rotate about the shaft 20, and the width of the U-shaped part of the locking portions 15*b* is made substantially the same as the diameter of the shaft 20, facilitating positioning of the head support member 15 in the back and forth direction.

Further, the locking portions 15*b* of the head support member 15 protrude down to the lower side of the thermal head 13, and this configuration of the locking portions 15*b* allows the center of the shaft 20 to overlap the extension line of the surface of the thermal head 13 on which the heat generating elements 13*a* are provided. Accordingly, upon rotating the head support member 15 toward the pressure plate 16 side, the back surface portion of the head support member 15 and the pressure plate 16 can be brought into intimate contact with each other with reliability.

The pressure plate 16 has openings 16*b* from which the locking pieces 15*a* of the head support member 15 are introduced, with the rest portions 16*a* on which the locking pieces 15*a* are placed to rest being provided on the bottom side of the openings 16*b*. The locking pieces 15*a* of the head support member 15 and the rest portions 16*a* of the pressure plate 16 are fastened together with the screws 12 while held in contact with each other. Further, a rectangular C-shaped cutout portion is formed substantially in the center of the pressure plate 16, allowing the FPC introduced from the back surface side to be passed on to the connector 13*b* of the thermal head 13.

Formed in the right and left side walls of the pressure plate 16 are forwardly-projecting flanges 16*c* provided with shaft holes 16*d* through which the shaft 20 is passed. In addition, provided rearward of the both side walls are overhanging portions 16*e* for supporting the lock arm 17. Note that when joined to the head support member 15, the pressure plate 16 also functions as heat radiating means for releasing the heat of the thermal head 13.

The lock arm 17 has a rectangular C-shaped configuration as a whole. Provided in the right and left side walls of the lock arm 17 are hook portions 17*a* that lock the bearing member for the platen roller (hereinafter referred to as the "platen-roller bearing member") securely in place, and shaft holes 17*b* through which the shaft 20 is passed. Further, formed in the lower rearward portion of the lock arm 17 are cutout portions 17*c* so that a back surface portion 17B of the lock arm 17 can be supported at the overhanging portions 16*e* of the pressure plate 16. Further, formed in the lower right of the back surface portion is a spring hole 17*d* for hooking on an end of a spring 21 that will be described later. With its other end being fixed onto a spring hole 18*c* provided in an erected wall 18*a* in a lower part of a right side wall 18R of the outer frame 18, the spring 21 thus urges the lock arm 17 rearward.

Further, arranged between the pressure plate 16 and the lock arm 17 are the springs 14 for pressing the pressure plate 16, causing a pressing force to act between the thermal head 13 and the platen roller. The springs 14 are each secured in place with its both ends respectively engaged with a protrusion (not shown) formed in the pressure plate 16 and a recess (not shown) formed in the lock arm 17. The springs 14 urge the back surface portion of the lock arm 17 and the pressure plate 16 so as to repel each other; at this time, the overhanging portions 16*e* entering the cutout portions 17*c* of the lock arm 17 serve as stoppers, restraining the back surface portion 17B of the lock arm 17 and the pressure plate 16 from moving away from each other beyond a certain distance. Further, the back surface portion 17B of the lock arm 17 is supported by means of the overhanging portions 16*e* of the pressure plate 16, with the result that the pressure plate 16 and the lock arm 17 are rotated integrally about the shaft 20.

The outer frame 18 is composed of a back surface portion 18B, a bottom surface portion 18F, a left side wall 18L, and the right side wall 18R which are integrally molded, with an opening 18*b* for introducing the FPC being formed substantially in the center of the back surface portion 18B. Further, provided on the right and left walls 18R and 18L of the outer frame 18 are receiving grooves 18*c* for retaining the platen-roller bearing member, and shaft holes 18*d* through which the shaft 20 is passed. Further, a gear support shaft 19 for supporting a gear is provided to the left side wall 18L, and provided in a lower part of the right side wall 18R is a spring hole 18*e* for attaching the spring 21 whose one end is fixed onto the spring hole 17*d* of the lock arm 17.

The lock arm 17 is normally pulled rearward by the spring 21 into intimate contact with the back surface portion 18B of the outer frame 18 with the hook portions 17*a* being also pulled rearward, allowing the platen-roller bearing member to be retained between the receiving grooves 18*c* provided in the right and left side walls 18R and 18L of the outer frame 18 and the hook portions 17*a* provided in the right and left side walls of the lock arm 17. Note that by pushing the rear portion of the lock arm 17 forward (or by pulling the front portion thereof), the lock arm 17 is rotated about the shaft 20 to separate the hook portions 17*a* of the lock arm 17 away from the platen-roller bearing member, thus making it possible to detach the platen roller.

As shown in FIG. 3, the shaft 20 is passed through the shaft holes 16*d* and the shaft holes 17*b* provided in the right and left side walls of the pressure plate 16 and the lock arm 17, respectively. Further, the ends of the shaft 20 are passed through the shaft holes 18*d* provided in the right and left walls 18R and 18L of the outer frame 18, and fastening fittings such as E rings are fastened and secured in place from the outside of the outer frame 18, whereby those components are assembled onto each other and do not separate from each other.

On the other hand, when the locking portions 15*b*, which are formed in the lower part of the right and left side walls of the head support member 15, are engaged with the shaft 20, and the head support member 15 is rotated toward the pressure plate 16, the locking pieces 15*a* are introduced from the openings 16*b* provided in the pressure plate 16. Then, the head support member 15 and the pressure plate 16 are joined together into intimate contact with each other by fastening with the screws 12 with the locking pieces 15*a* of the head support member 15 held in contact with the rest portions 16*a* of the pressure plate 16.

Figure 4B:
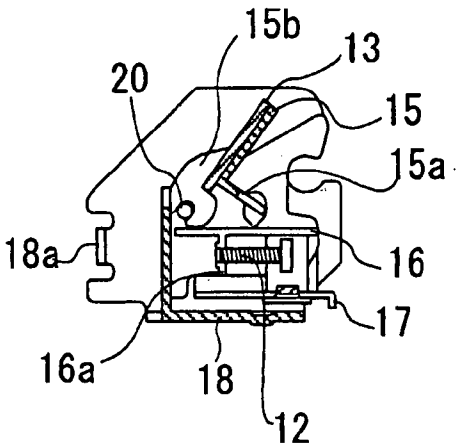
FIG. 4B is a cross-sectional view taken along the line A—A of FIG. 4A.
Figure 4A:
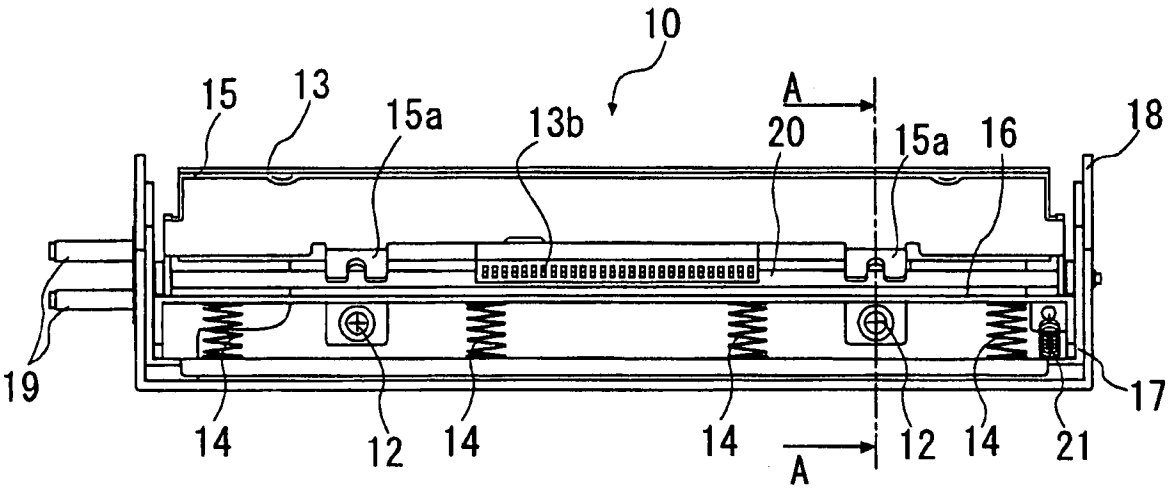
FIG. 4A is a top view showing the printing mechanism from which the head support member 15 is being detached.

FIG. 4A is a top view showing the printing mechanism from which the head support member 15 is being detached. FIG. 4B is a cross-sectional view taken along the line A—A of FIG. 4A.

As shown in FIGS. 4A and 4B, to detach the head support member 15 from the pressure plate 16, first, each screw 12 is loosened to a degree such that the lower end of the screw 12 does not dislodge from the rest portion 16*a* of the pressure plate 16, and then the head support member 15 is rotated forward about the shaft 20 to thereby take out the locking pieces 15*a* of the head support member 15 from the openings 16*b*. Since the locking pieces 15*a* of the head support member 15 are each formed in a U-shaped configuration and engaged with the screw at its recessed portion, the locking pieces 15*a* can be pulled out without fully unscrewing the screws 12 from the rest portions 16*a* of the pressure plate 16. Therefore, a marked improvement can be attained in terms of operability. Further, there is no fear of the screws 12 getting lost. It is to be noted that an operation reverse to the operation described above is performed when attaching the head support member 15 to the pressure plate 16.

Figure 5B:
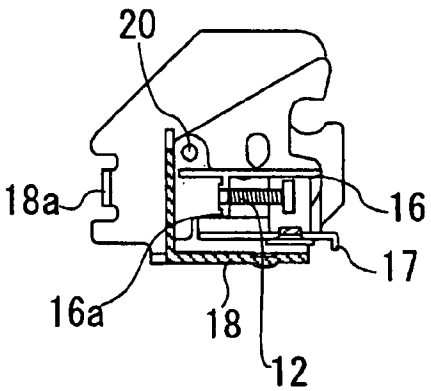
FIG. 5B is a cross-sectional view taken along the line A—A of FIG. 5A.
Figure 5A:
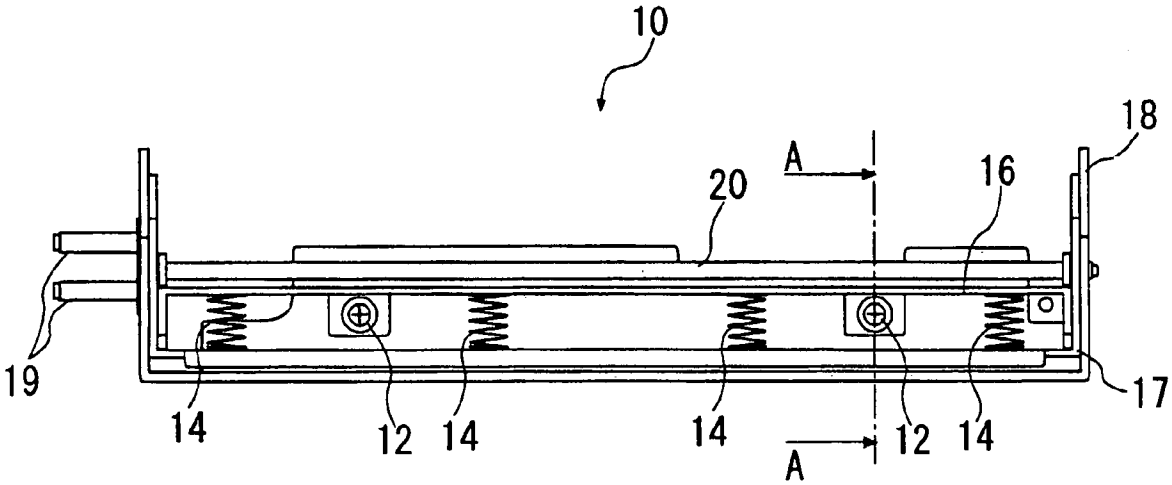
FIG. 5A is a top view showing the printing mechanism from which the head support member 15 has been detached.

FIG. 5A is a top view showing the printing mechanism from which the head support member 15 has been detached, and FIG. 5B is a cross-sectional view taken along the line A—A of FIG. 5A.

Once the head support member 15 has been detached, only a printing mechanism 10 as shown in FIG. 5A remains in the thermal printer. Since the head support member 15 is detachable from the pressure plate 16 in the thermal printer of this embodiment as described above, only the head support member 15 needs to be detached when replacing the thermal head 13, and other parts attached to the outer frame 18 are not replaced. Therefore, unlike according to the previously filed application (JP 2002-283230 B) described above, it is not necessary to perform such replacement by detaching the entire lock arm 17 to which the head support member 15 is attached, making it possible to avoid an increase in parts cost incurred while replacing the thermal head 13 and therefore to achieve reduced maintenance cost.

Figure 6:
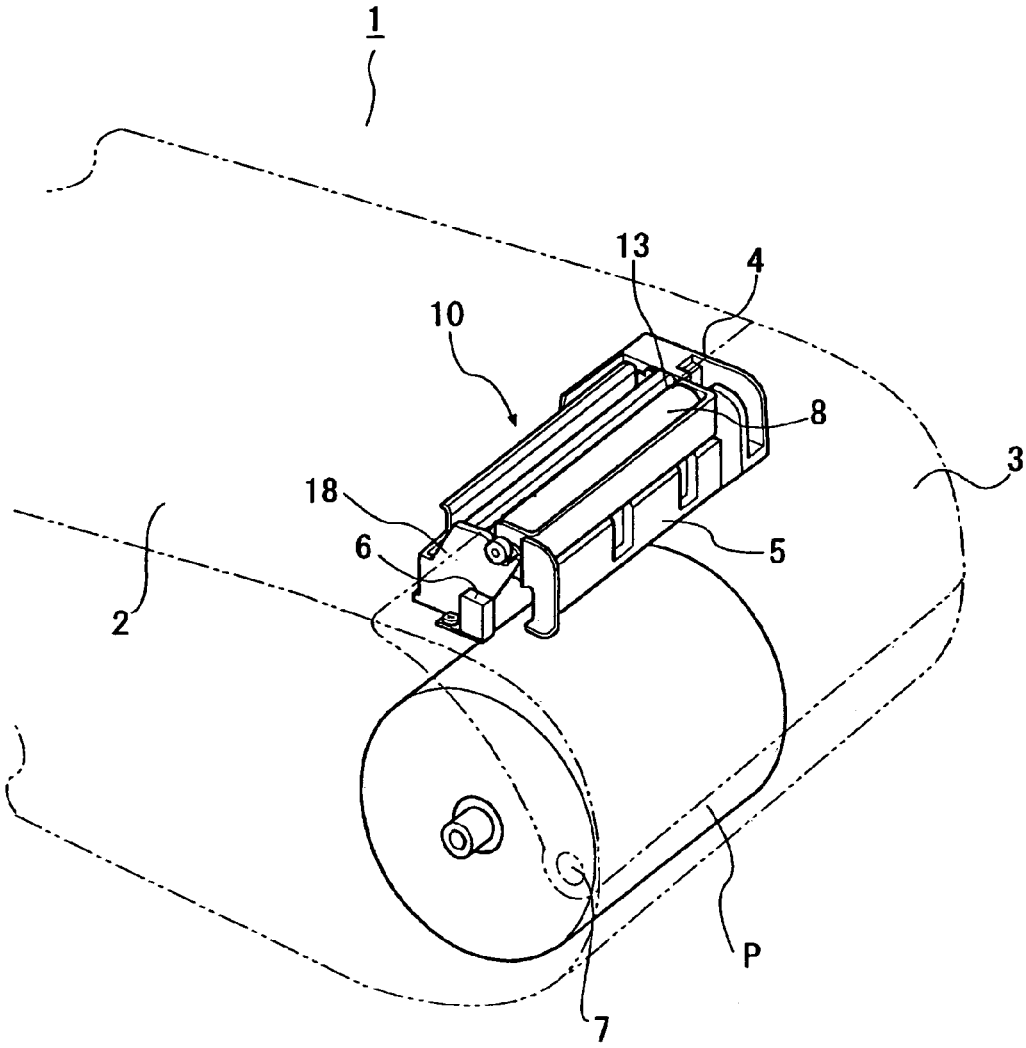
FIG. 6 is a perspective view showing the printing mechanism and its vicinity in the thermal printer according to the embodiment of the present invention.

FIG. 6 is a perspective view showing the printing mechanism and its vicinity in the thermal printer of this embodiment.

Referring to FIG. 6, reference numeral 1 denotes a thermal printer main body, 4 denotes a gear box containing a gear for rotating a platen roller 8, 5 denotes a sheet guide which guides a sheet into between the platen roller 8 and the thermal head 13, 6 denotes a fixture for fixing the outer frame 18 to the printer main body, and symbol P denotes a sheet retaining portion where rolled sheets are retained.

The outer casing of the thermal printer 1 is constituted by a main housing 2 and a movable cover 3 that opens and closes to expose a part of the printing mechanism 10. A sheet delivery portion and a sheet cutter are provided between the main housing 2 and the movable cover 3. A label on which printing has been performed is delivered from the sheet delivery portion. That is, the forward end of the movable cover 3 is located in (or in the vicinity of) the portion where the thermal head 13 and the platen roller 8 come into contact with each other, and is normally covered by the main housing 2.

When the thermal head 13 is to be replaced in the thermal printer 1 constructed as described above, the movable cover 3 is opened to detach the platen roller 8, and then the head support member 15 is detached. At this time, the screws 12 serving as joining means for joining the head support member 15 to the pressure plate 16 is covered by the main housing 1, which means that opening the movable cover 3 alone does not make the screws 12 visible from the outside. However, the head support member 15, the pressure plate 16, and the lock arm 17 are rotatable about the shaft 20; hence, rotating them toward the opening side causes the joining portion (screws 12) to be exposed, which makes it possible to detach only the head support member 15 by loosening the screws 12.

While the present invention as implemented by the inventor has been described above in detail based on the embodiment thereof, the present invention is not to be limited to the above-described embodiment and can be subject to various modifications. For example, while in the above embodiment the U-shaped recess is formed in each of the locking pieces 15*a* of the head support member 15, a through hole through which the screw is passed may be provided instead. In this case, by forming the locking pieces 15*a* at a slightly upward incline with respect to the horizontal direction, simple fastening with the screws 12 can enhance the intimate contact between the head support member 15 and the pressure plate 16.

What is claimed is:

1. A thermal printer which performs printing on a sheet sandwiched between a thermal head having a heat generating element and a platen roller, the thermal printer comprising:

a first frame for retaining a printing mechanism including the thermal head and the platen roller;

a head support member to which the thermal head is secured;

a pressure plate that detachably retains the head support member;

joining means for joining the head support member and the pressure plate together;

a support shaft passed through a shaft hole provided in each of both side walls of the first frame, the support shaft rotatably supporting the head support member;

a second frame which is rotatable integrally with the pressure plate about the support shaft; and urging means suspended between the pressure plate and the second frame, for generating a pressing force between the thermal head and the platen roller in a state where the head support member is joined to the pressure plate.

2. A thermal printer according to claim 1, wherein the head support member has in a lower part of its each side surface an engaging portion adapted to engage with the support shaft, the head support member being placed into a predetermined position by rotating the head support member toward the pressure plate by engaging the engaging portion with the support shaft.

3. A thermal printer according to claim 2; wherein the head support member has a locking portion for joining the head support member to the pressure plate;

the pressure plate has a rest portion on which the locking portion is placed to rest; and the head support member and the pressure plate are joined together by fastening with a screw while the locking portion and the rest portion are held in contact with each other.

4. A thermal printer according to claim 3, wherein the locking portion comprises a U-shaped locking piece capable of engaging with the screw.

5. A thermal printer according to claim 1; wherein the head support member has a locking portion for joining the head support member to the pressure plate;

the pressure plate has a rest portion on which the locking portion is placed to rest; and the head support member and the pressure plate are joined together by fastening with a screw while the locking portion and the rest portion are held in contact with each other.

* * * * *